US005190298A

United States Patent [19]

Lee et al.

[11] Patent Number: 5,190,298

[45] Date of Patent: * Mar. 2, 1993

[54] AMUSEMENT DEVICES

[75] Inventors: James S. W. Lee, Long Island, N.Y.; Chiu K. Kwan, Kowloon, Hong Kong

[73] Assignee: C. J. Associates, Ltd., Monrovia, Liberia

[ * ] Notice: The portion of the term of this patent subsequent to Jul. 2, 2008 has been disclaimed.

[21] Appl. No.: 644,841

[22] Filed: Jan. 23, 1991

Related U.S. Application Data

[63] Continuation-in-part of Ser. No. 504,542, Apr. 4, 1990, Pat. No. 5,028,047.

[51] Int. Cl.[5] ..... A63F 9/00; A63F 9/18; A63F 9/06

[52] U.S. Cl. ..... 273/430; 273/441; 273/447; 434/327; 434/331

[58] Field of Search ..... 273/447, 441, 442, 443, 273/153 R, DIG. 24, 243, 430; 434/327-331, 335, 337, 344; 283/72

[56] References Cited

U.S. PATENT DOCUMENTS

| | | | |
|---|---|---|---|
| 3,068,010 | 12/1962 | Hagopian | 434/331 X |
| 3,081,088 | 3/1963 | Kast | 273/153 R |
| 3,508,344 | 4/1970 | Thomas | 283/72 X |
| 3,717,341 | 2/1973 | Blanton, Jr. | 273/447 |
| 3,734,509 | 5/1973 | Glass et al. | 273/DIG. 24 X |
| 4,028,118 | 6/1977 | Nakasuji et al. | 434/328 X |
| 4,066,265 | 1/1978 | Bredlau | 273/153 R |
| 4,354,682 | 10/1982 | Vcala | 273/DIG. 24 X |
| 4,586,715 | 5/1986 | Scolari et al. | 273/DIG. 24 X |
| 4,743,030 | 5/1988 | Auer et al. | 434/327 X |
| 4,863,164 | 9/1989 | Mizunuma | 273/447 |
| 4,891,011 | 1/1990 | Cook | 434/331 X |
| 5,028,047 | 7/1991 | Lee et al. | 273/447 |

FOREIGN PATENT DOCUMENTS

| | | | |
|---|---|---|---|
| 2197213 | 5/1988 | United Kingdom | 273/243 |

*Primary Examiner*—Paul E. Shapiro
*Attorney, Agent, or Firm*—Laff, Whitesel, Conte & Saret

[57] ABSTRACT

Memory-oriented or pattern matching games use game pieces having indicia which become excited responsive to a brief exposure to strong light or another activating event for emitting colored light during a short period of time. The games use the excitable indicating medium to present certain information to the players for a short time period. Thereafter, the players are required to use their memory of the temporarily-presented information in order to accomplish some task. In some embodiments, the games present a random arrangement of color-coding which soon becomes invisible after the excitement subsides. Then, the players must use their memory of the game piece locations to select only those pieces which are assigned to them. In another embodiment of the invention, a maze is printed in excitable ink which is visible only during the short time period of excitement. The players must try to complete the maze before the pattern, or their memory of it, dissipates. In a fourth embodiment, players receive a question or clue, and must select one among several answers. After their selection, the correct answer is revealed by exposure of excitable ink to a strong light or other activating event.

8 Claims, 2 Drawing Sheets

AMUSEMENT DEVICES

This application is a Continuation-in-Part of application Ser. No. 07/504,542 filed Apr. 4, 1990, now U.S. Pat. No. 5,028,047.

This invention relates to amusement devices, and more particularly to games for using and developing memory and pattern-recognition skills in players.

A number of games have been developed in the past for using and developing memory and pattern recognition skills among players. In general, such games permit the players to view a pattern of information for a brief period. The pattern is then obscured, and the players are required to take some further action based on their memory of the pattern.

A variety of schemes have been developed to intermittently obscure and reveal game cards, pieces, patterns, puzzles and various other elements of prior-art memory and pattern recognition games. Most of these schemes involve cards or enclosures that hide from view some kind of pattern which has been either prepared in advance by the players, or selected by the players in advance from a limited set of manufacturer-prepared patterns. Creation or selection of the pattern itself may involve a significant effort by the players, as may the arrangement of the various view-hiding game elements.

An example of such a memory and pattern recognition game using the obscuring card concept has been sold under the name "CONCENTRATION". In this game, a pictographic puzzle is placed below a transparent fixture. For each available prize, there exists a pair of prize-identifying cards distributed at scattered section locations.

One object of the game is to win prizes by remembering the locations of, and calling out during the same turn, both of the cards representing a particular prize. If the revealed prizes do not match, the section-identifying cards are replaced. If the revealed prizes match, the prize cards are permanently removed to reveal an additional portion of the underlying puzzle.

A problem with this game and others like it is that it is difficult to prepare the game apparatus for play. Successful play requires the proper sequential, layered installation of prize cards and section-identifying cards in correct positions. The loss of a single prize or section-identifying card can ruin the game. The preparation required may be too difficult for young children, and even for adults, the significant effort involved may obviate the game's recreational value.

An additional problem with many of the games directed to memory and pattern recognition skills is their lack of attractive gadgets. Users appear to find games that include an interesting mechanism or scientifically curious feature more entertaining and enjoyable than games which lack these attributes.

Accordingly, the need exists for games to teach, enhance, and exercise memory and pattern recognition skills which do not require extensive preparation by the user.

It is, therefore, an object of the present invention to provide a memory oriented game which requires little preparation by the players in advance of play.

It is another object of the invention to provide a memory oriented game which provides attractive features to capture the interest of young players.

According to the present invention, novel memory-oriented or pattern matching games use game pieces having indicia which is revealed responsive to a brief exposure to strong light or another activating event for subsequently causing the game pieces to emit light of a distinguishing color for a short predetermined period. The general scheme of the inventive games is to use the indicating medium to present certain information to the players for a short period, and to thereafter require the players to use their memory of the temporarily- presented information to accomplish some task.

In first and second embodiments of the invention, game pieces are marked with an indicating medium which is excited to become visible during only a short time period after exposure to a bright light or other activating event. The pieces are randomly arranged and exposed to the activating event to reveal the indicia. The players must use their memory to select certain of the pieces after the indicia again becomes invisible.

In a third embodiment of the invention, a maze is printed using ink which is excited to become visible during only a short time period after exposure to a bright light or other activating event. The players must try to complete the maze before the pattern, or their memory of it, dissipates.

In a fourth embodiment of the invention, a game board has areas representing important cities of the world. The players are provided with cards bearing a clue which may be associated with one of the cities on the game board. The card also bears the correct answer. The clue and answer are printed using ink which is excited to become visible only during a short time period after exposure to a bright light or other activating event. The clue is exposed first, and the player must try to select the city to which the clue is associated. Subsequently, the answer is exposed so that the players may determine whether the guess is correct.

These and other features of this invention will be best understood by reference to the following detailed description of a preferred embodiment of the invention, taken in conjunction with the accompanying drawings, in which.

Figure 1:
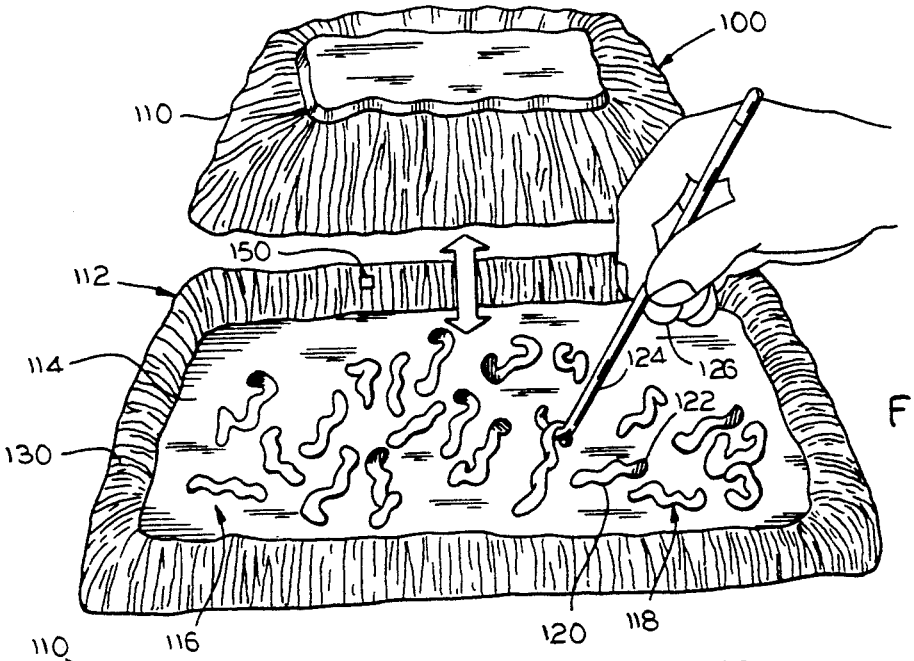
FIG. 1 is a perspective view of a memory-based selection game device according to the present invention.

A first embodiment 100 of a game device according to the present invention is best seen overall in FIG. 1. The object of game 100 is to present to the players a random arrangement of game pieces having distinguishing indicia which vanish after a predetermined time period. The players may memorize the positions of some or all of the game pieces displaying various indicia to preferably select only those pieces displaying a particular indicium.

The game has a base unit which is preferably constructed as a bowl-or trough-like container 112 having a perimeter wall or ridge 130 and a removable cover 110. A plurality of game pieces 120 are provided for random arrangement on an interior display surface 114 within the container 112. The game 100 preferably has ornamental features which make it interesting to young players. For example, as best seen in FIG. 1, the game pieces 120 are styled as worms, and the perimeter wall 130 and cover 110 are textured and colored to resemble mounds of dirt.

The game pieces 120 are preferably divided into two or more groups, and each group is assigned to a player of the game. The pieces in each group are distinctively marked with an indicating medium 122 which is visible only under controlled circumstances. A key feature of the game is that the indicating medium applied to the game pieces may be activated upon demand such that the indicating medium is visible for a relatively short predetermined time thereafter. Preferably, the game pieces are constructed so that players can distinguish pieces belonging to one group from pieces belonging to any other group exclusively during the time the indicating medium is has been made visible by activation. The game pieces need not all be identically constructed, however. It is merely necessary for the players to be unable to correlate the group to which any game piece belongs by using any feature other than the activated indicating medium. The several groups of game pieces may be distinguished by providing different colored indicating media, or, where appropriate, by leaving the game pieces of one group unmarked.

A number of such indicating media are well known in the art. It is believed that a "photochromic" ink, dye, pigment, or other material is a preferred indicating medium for the games disclosed herein. Photochromic material, as used herein, means a material which glows or changes color temporarily upon exposure to light. While photochromic materials are believed preferable for use in these games, any other appropriate indicium which may be activated upon demand and which vanishes on demand or after an at-least-approximately predetermined period could also be used. For example, the indicium could be a fluorescent material which glows only during exposure to light of an appropriate wavelength, involving a special light. For example, if suitable safeguards are provided, an ultraviolet lamp may be used to produce appropriate light. Alternatively, the indicium could be a material which changes color when exposed to water or to an extreme of temperature.

The cover 110 preferably includes a device (not shown) for activating the indicating medium of the game pieces. If the indicating medium is a photochromic material of the type previously described, it is believed that light sources providing a brief, high-intensity flash of light with a significant portion of the output distributed in the shorter visible wavelengths is preferred to other possible sources, because the described sources cause the photochromic material to glow relatively brightly for 30 to 4 seconds and to subside quickly into invisibility thereafter. A flash device having a Xenon flash tube, such as is commonly available for use in photography, appears to be a suitable light source. Other light sources could also be used. When cover 110 is properly installed on container 112, the cover and container cooperate to substantially attenuate any light which may be emitted from the container during operation of the light source. Preferably, the cover 110 or the container 112 have a detector 150 to inhibit operation of the light source unless the cover 110 is properly installed on the container 112. For other types of indicating media, a different activating device may be required.

Figure 1A:
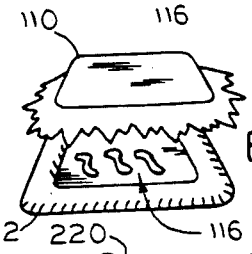
FIG. 1A is a detailed perspective view of a portion of the game device of FIG. 1 showing a first step in the operation of the game.
Figure 1B:
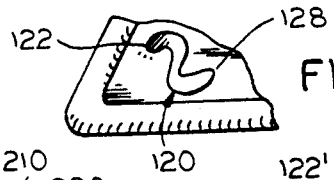
FIG. 1B is a detailed perspective view of a portion of the game device of FIG. 1 showing a second step in the operation of the game.
Figure 1C:
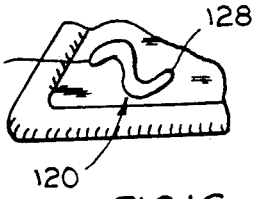
FIG. 1C is a detailed perspective view of a portion of the game device of FIG. 1 showing a third step in the operation of the game.

As best seen in FIG. 1, the game pieces 116 are preferably arranged randomly in container 112. The game pieces are shown with their indicating media in the activated state. A game piece 120 belongs to a first group of game pieces which are marked at one end with the indicating medium 122. A game piece 118 belongs to a second group of game pieces which lack the indicating medium and are thereby distinguished from the game piece of the first group.

Where a photochromic ink material is chosen as the as the indicating medium for game pieces, the behavior of the medium is best seen in FIGS. 1A–1C. In FIG. 1A, the light source inside cover 110 produces a bright flash of light to expose game pieces 116 arranged in container 112. FIG. 1B shows one of the game pieces 120 which bears at one end thereof the indicating medium 122 about 10 seconds after the flash. The indicating medium is clearly visible to permit a player to distinguish that game piece 120 from other game pieces which are not marked or which are marked with a different color indicating medium. FIG. 1C shows the same game piece 120 about 60 seconds after the flash. The glow from the indicating medium 122 has subsided, the indicating medium is no longer visible, and game piece 120 is no longer distinguishable, at least on that basis, from any other game piece.

In order to play the game, the players activate the flash device and remove the cover 110. The game pieces 120 containing photochromic ink 122 glow brightly for a short period, during which time each player may distinguish the particular group to which each game piece belongs and may memorize the locations of the game pieces which are members of the group assigned to him. Once the glow subsides, the players take turns removing the game pieces from the container 112, using their memory of the previously-revealed game piece locations to select only those game pieces in the groups assigned to them. The players 126 may be required to use a tool to remove the game pieces, such as the hook 124 shown in FIG. 1, to increase the physical skill required to play the game. In order to tally the score of the game, the pieces selected by each player may temporarily be returned to the container 112 to be excited by another flash of light, thereby revealing the indicating medium.

Figure 3:
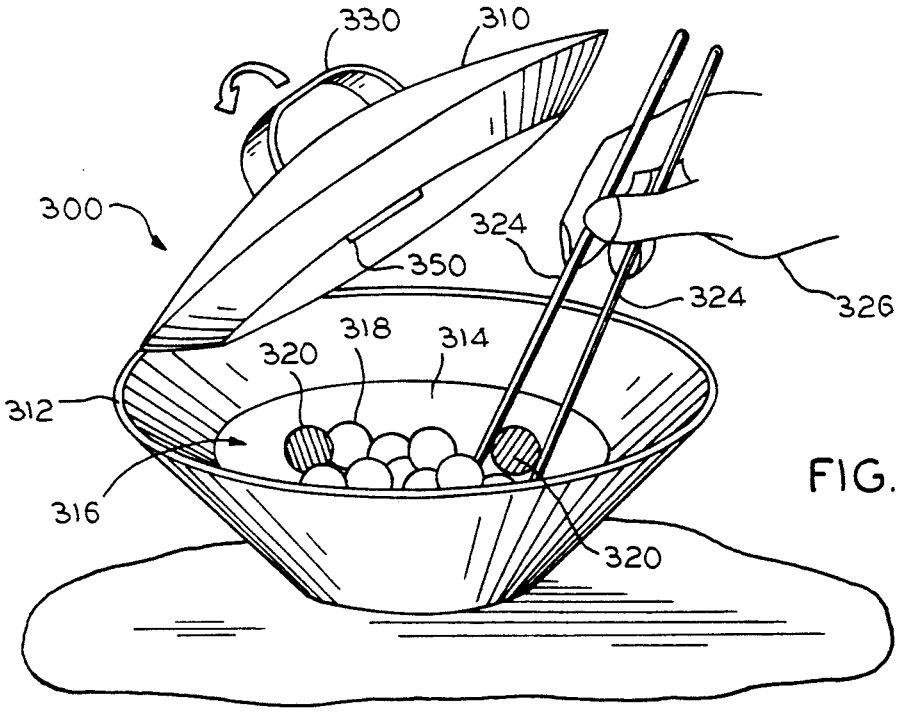
FIG. 3 is a perspective view of a third embodiment of a game device according to the present invention.

As best seen in FIG. 3, a second embodiment 300 of a game according to the invention includes game pieces 316 formed as small spheres. The game has a base unit which is preferably constructed as a bowl 312 resembling a wok. The game is prepared and played in much the same way as the previously described game 100. The game pieces 316 are preferably randomly arranged on an internal display surface 314 within container 312. The game pieces 316 are divided into at least two groups which are distinguishably marked using an appropriate indicating medium as previously described. A removable cover 310 preferably contains an appropriate device 350 for activating the indicating medium of the game pieces. Players are provided chopsticks 324 for removing the game pieces from the container 312. The use of chopsticks 324 requires a physical skill which adds to the challenge of the game. The game 100 preferably has ornamental features which make it interesting to players. For example, the container 312, internal display surface 314, and cover 310 may be decorated in a food or cooking oriented motif. The game 300 may be played using the same procedure as the previously described embodiment 100.

Figure 2:
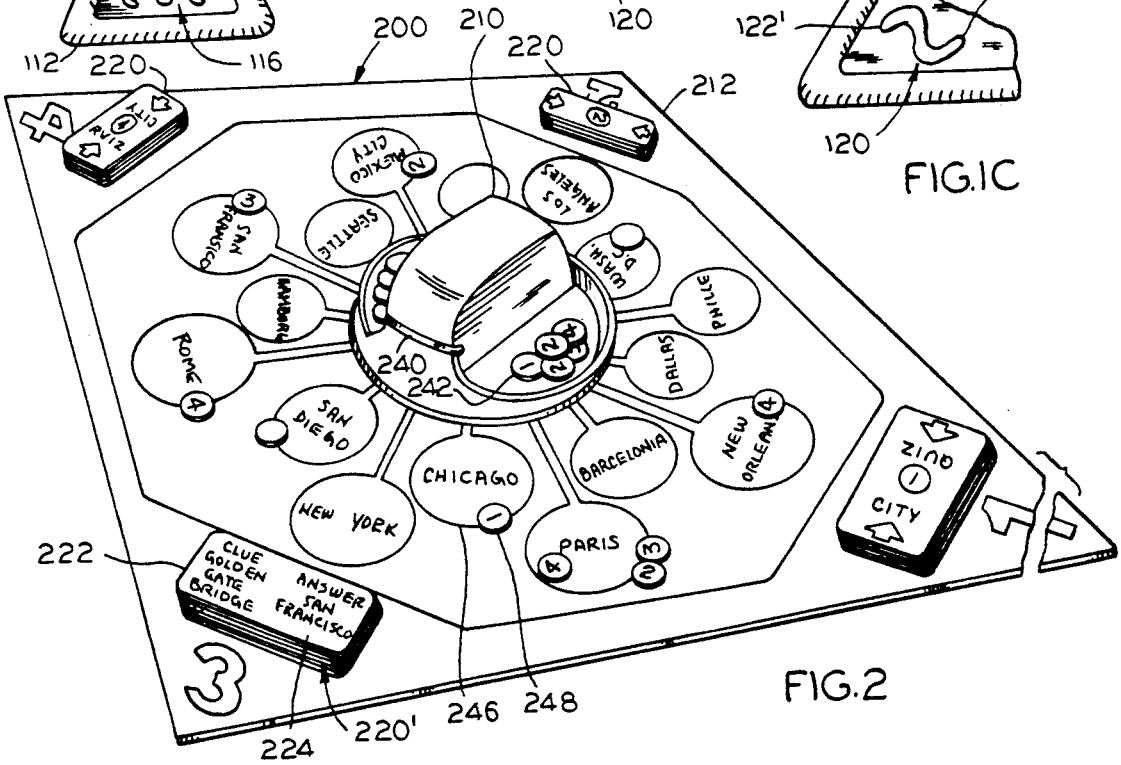
FIG. 2 is a perspective view of a second embodiment of a game device according to the present invention.

As best seen in FIG. 2, a third embodiment 200 of a game according to the invention includes a game board 212 having areas 246 representing important cities of the world. The players are provided with cards 220 bearing a clue which may be associated with one of the cities on the game board 212. The object of game 200 is to correctly identify the city matching the clue displayed on the card 220. Each card 220 also bears the correct answer. The clue and answer are printed using an indicating medium of the type previously described in connection with the embodiments 100, 200. The following table lists some examples of clues and corresponding cities.

| CLUES | CITIES |
|---|---|
| "I left my heart . . . " | San Francisco |
| Fisherman's Wharf | |
| Best U.S. Chinese Food | |
| 49'ers | |
| North Beach | |
| Space Needle | Seattle |
| Mariners | |
| Supersonics | |
| Seahawks | |
| Largest City | Mexico City |
| Chicimangas | |
| Astrodome | Houston |
| Oilers | |
| Cougars | |
| Angels | Los Angeles |
| Freeway | |
| Bruins | |
| Bel Air | |
| Queen Mary | |
| Rodeo Dr. | |
| Lincoln | Washington, D.C. |
| Jefferson | |
| Patomic | |
| Space Museum | |
| Bill of Rights | |
| Bois De Bolonge | Paris |
| Tulleres | |
| Winged Victory | |
| Eiffel Tower | |
| Arc De Triumph | |
| Metro | |
| "Toddl'n Town" | Chicago |
| Stock Yards | |
| Tallest Building | |
| Michigan Blvd. | |
| "El" | |
| Cubbies | |

The game board 212 preferably has an appropriate device 210 for activating the indicating medium of the game pieces. The clue and answer are preferably only visible for a controlled period during or after activation by activation device 210. The cards 220 and activation device 210 are constructed so that the clue may be exposed without simultaneously exposing the answer. As best seen in FIG. 2, the activating device 210 may be constructed as a small protruding enclosure having a thin slot 240 to receive a portion of the clue card. An appropriate stop means (not shown) may be used to permit only a predetermined amount, such as one half, of the card to be inserted to prevent the undesired exposure of the entire card at one time. The clue is preferably exposed first, and the player must try to select the city to which the clue is associated. Subsequently, the answer is exposed so that the players may determine whether the guess is correct. A card 220' is shown as it would appear after having been exposed in its entirety by activation device 210. Both the clue 222 and the answer 224 are visible.

During play, each player receives several clue cards 220. Each player also receives a number of distinctive tokens 248. To play the game, a player exposes one of the clues 222 on a card 220 using the activation device 210 and attempts to select the corresponding city among those represented on the game board 212. The player places one of his tokens 248 on the area 246 of the game board 212 representing that city. The player may then expose the answer portion 224 of the card to see if his choice was correct. If the player's choice was correct, he may leave his token on the game board and play another clue card. If the player's choice was incorrect, he must remove his token and relinquish control of the game to the next player in turn. A player wins when he has placed all of his tokens on the board.

In a variation of this game, clues of varying difficulty may be provided on the cards which are plainly marked to identify the level of difficulty. A player successfully identifying the city associated with a more difficult clue would be rewarded by being permitted, during that single turn, to dispose of a greater number of tokens corresponding to the level of difficulty.

In a fourth embodiment 400 (FIG. 4) of a game according to the present invention, a base unit 412 is provided having a maze 454 or other pattern imprinted thereon using an indicator medium as previously described with respect to the first three embodiments. The game 400 has a cover 410 containing a suitable device 450 for activating the indicator medium.

The maze 454 or other pattern is invisible except during activation by activation device 450 or for a predetermined period thereafter. The object of the game 400 is to display to the player a short-lived image of the maze or pattern 454, and to challenge the player to complete the maze 454 (or perform an appropriate activity associated with another pattern) before the pattern and the player's memory thereof dissipates.

Figure 4:
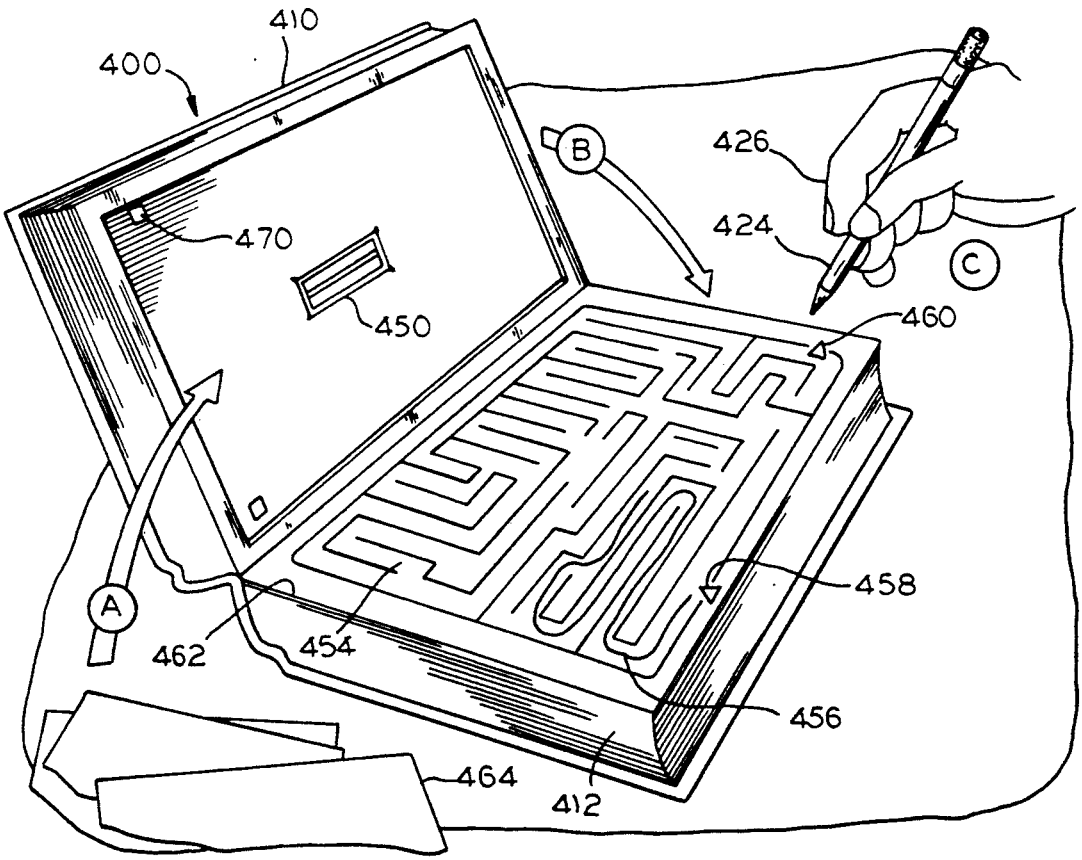
FIG. 4 is a perspective view of a fourth embodiment of a game device according to the present invention.

As best seen in FIG. 4, after the indicating medium has been activated, a typical maze 454 would appear as a pattern of lines with an identified starting point 458 and an identified ending point 460. However, many other patterns could also be used. For example, a random pattern of dots could be displayed, and the players could connect the dots in a creative fashion to form a picture of an object or animal.

The base unit 412 and cover 410 are preferably constructed having ornamental features attractive or interesting to a player. For example, the base unit 412 and cover 410 may have the appearance of a hard-bound book as shown in FIG. 4, so as to effectively disguise the game function when the cover 410 is closed. In order to maintain the players' interest, a large number of mazes or patterns may be supplied on removable cards 464. To prevent the players from spoiling a maze or pattern card during each play, a transparent window-like protective sheet 462 may be used to overlay the maze or pattern card. An appropriate marking pen 424 which is compatible with the protective sheet may be used so that a player 426 may draw a maze solution 456 directly on the protective sheet 462. Marks 456 produced by the marking pen 424 are preferably conveniently erasable from the protective sheet.

If the activation device 450 is a bright light source, it is preferred that the cover 410 and base unit 412 cooperate to substantially attenuate any light (e.g. via leakage) which may be emitted from these parts during operation. Preferably, the cover 410 or the base unit 412 have a detector 470 to inhibit operation of the light source unless the cover 410 is properly installed on the base unit 412.

To play the game, a player closes the cover 410, operates the activation device 450, and reopens the cover 410 to reveal maze or other pattern 454. The player attempts to mark a solution to the maze or pattern before it, or his memory of it, subsides.

The above-described embodiments of the invention are merely examples of ways in which the invention may be carried out. Other ways may also be possible, and are within the scope of the following claims defining the invention.

What is claimed is:

1. A game apparatus comprising means for producing an activating event; first and second group of game pieces; at least one of said groups of game pieces being marked with an indicating medium, said indicating medium being excited responsive to said activating event, said excitement continuing during only a predetermined time period following said activating event; said first and second groups being distinguished during said period while said medium is excited and being indistinguishable from each other except during the period while said indicating medium is excited; a container for displaying a random arrangement of individual ones of said first and second groups of game pieces; a cover for containing said means for producing said activating event; and means for selectably removing individual ones of said first and second groups of game pieces from said container.

2. The game apparatus of claim 1 wherein said indicated medium is visibly distinguishable while it is excited.

3. The game apparatus of claim 1 wherein said activating event is a brief flash of bright light; and said indicating medium is a photochromic ink responsive to said flash of light for emitting a distinctive color during the period of excitement after said activating event.

4. The game apparatus of claim 3 further comprising means for preventing an operation of said means for producing said flash of light unless said cover is properly installed on said container.

5. A game apparatus comprising means for producing an activating event; a plurality of game pieces; said game pieces each having first indicium and second indicium thereon; said first game piece indicium being a clue or question; said second game piece indicium being an answer to said clue or question of said first game piece indicium; said second game piece indicium being printed by using an excitable indicating medium, which is excited responsive to said activating event for becoming visible during only an approximately predetermined time following said activating event after which said excitement of said medium subsides and said visibility disappears; a game board having a plurality of indicia corresponding to said excitable second game piece indicia; said first game piece indicium is printed by using an indicating medium which is excited to become visible only during said predetermined time period; said activating event being a brief flash of bright light; said indicating medium being excitable photochromic ink which responds to said bright flash by emitting light of a distinctive color when excited; and said means for producing said activating event comprises means for exposing only an excitable one of said first and second game piece indicia to said flash of bright light while preventing a simultaneous exposure of the other of said first and second game piece indicia to said flash of bright light.

6. A game apparatus comprising means for producing an activating event; a game piece for displaying a pattern for completion by a player in response to said event; said pattern being printed in an excitable indicating medium which is excited in response to said activating event for becoming visible only during an approximately predetermined time period following said activating event; said pattern being invisible except when said indicating medium is excited; a base unit for holding said game piece; a protective sheet for receiving markings made by a player; and a cover for containing said means for producing an activating event.

7. The game apparatus of claim 6 wherein said activating event is a brief flash of bright light; and said indicating medium is a photochromic ink which is excited responsive to said bright light for emitting light of a distinctive color while said ink is excited.

8. The game apparatus of claim 7 further comprising means for preventing said bright flash of light unless said cover is properly installed on said base unit.

* * * * *